US011712123B1

(12) United States Patent
Joe et al.

(10) Patent No.: US 11,712,123 B1
(45) Date of Patent: Aug. 1, 2023

(54) BEVERAGE CONTAINER WITH ILLUMINABLE ARRANGEMENT

(71) Applicants: Diana Joe, Rosemead, CA (US); Ruby J. Espinoza, Rosemead, CA (US); Weimin Li, Katy, TX (US)

(72) Inventors: Diana Joe, Rosemead, CA (US); Ruby J. Espinoza, Rosemead, CA (US); Weimin Li, Katy, TX (US)

( * ) Notice: Subject to any disclaimer, the term of this patent is extended or adjusted under 35 U.S.C. 154(b) by 0 days.

(21) Appl. No.: 17/971,373

(22) Filed: Oct. 21, 2022

(51) Int. Cl.

| | |
|---|---|
| ***A47G 19/22*** | (2006.01) |
| ***A45F 5/00*** | (2006.01) |
| ***F21V 23/04*** | (2006.01) |
| ***F21Y 115/10*** | (2016.01) |

(52) U.S. Cl.
CPC ..... *A47G 19/2227* (2013.01); *A45F 5/00* (2013.01); *A47G 19/2222* (2013.01); *A47G 19/2266* (2013.01); *A47G 19/2272* (2013.01); *F21V 23/04* (2013.01); *A45F 2005/006* (2013.01); *A45F 2200/0583* (2013.01); *A47G 2019/2238* (2013.01); *F21Y 2115/10* (2016.08)

(58) Field of Classification Search
CPC ..... A47G 19/2227; A47G 19/2266; A47G 19/2272; A47G 19/2222; A47G 2019/2238
See application file for complete search history.

(56) References Cited

U.S. PATENT DOCUMENTS

| | | | | |
|---|---|---|---|---|
| 5,878,898 | A * | 3/1999 | Shefflin | A61J 9/085 215/11.1 |
| 6,196,413 | B1 * | 3/2001 | Tung | B65D 47/0885 220/717 |
| 8,186,537 | B2 * | 5/2012 | Rosnak | B65D 47/06 220/709 |
| 2004/0233661 | A1 * | 11/2004 | Taylor | A47G 19/2227 362/802 |
| 2006/0207410 | A1 * | 9/2006 | Kim | A47G 19/2227 84/600 |
| 2020/0069090 | A1 * | 3/2020 | Bloom | A47G 19/2227 |
| 2020/0138212 | A1 * | 5/2020 | Nishijima | A47G 21/188 |
| 2021/0190307 | A1 * | 6/2021 | Brown | A47G 23/0225 |

* cited by examiner

*Primary Examiner* — William N Harris
(74) *Attorney, Agent, or Firm* — Raymond Y. Chan; David and Raymond Patent Firm

(57) ABSTRACT

A beverage container includes a container bottle and an elevated container lid. The elevated container lid includes a lid member detachably and coaxially connected to a top end of the container bottle to cover a top opening of the container bottle, and a hollow elevated drinking spout member having a base portion coaxially mounted on the lid member, a mouthpiece portion integrally and coaxially extended from the base portion, and a drinking opening coaxially formed at a top end of the mouthpiece portion, wherein the mouthpiece portion of the elevated drinking spout member has a nipple shape and the drinking opening has a size equal to or slightly larger than a diameter of a straw to be inserted therethrough into the interior cavity until reaching the bottom wall of the container bottle.

23 Claims, 9 Drawing Sheets

BEVERAGE CONTAINER WITH ILLUMINABLE ARRANGEMENT

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a beverage container, and more particularly to a beverage container equipped with a drinking spout and a straw coupling opening and including an illuminable arrangement installed in a detachable manner for selectively decorating the container bottle and the beverage contained therein.

Description of Related Arts

Travel cup is a common container used for takeout beverages such as ice tea, flavored tea, coffee, water, milk, juice, and the like, for traveling or outdoor party. As shown in FIG. 1A and FIG. 1B, conventional travel cup is illustrated with different lids for different drinking habits. To user who likes to use straw to drink, as shown in FIG. 1A, a lid with a straw opening for inserting a straw into the cup is used to engage with the cup opening edge. To user who likes to drink directly, as shown in FIG. 1B, a lid with a spout is used to engage with the cup opening edge. However, no matter a straw type or a spout type lid is used, the beverage may splash or spill out of the straw opening or the spout opening easily causing unnecessary inconvenience to the user. In addition, during a party or a carnival, each attendant may carry his or her own beverage cup. Flashing lights can really add much atmosphere and the beverage cups carried by the attendants would be excellent decorative tools if they can perform illuminating and flashing effects to the banquet venue.

SUMMARY OF THE PRESENT INVENTION

The invention is advantageous in that it provides a beverage container with illuminable arrangement, which includes an elevated container lid that not only allows the user to drink as a drinking spout but also allows the user to drink with a straw inserted stably through a spout opening thereof.

Another advantage of the invention is to provide a beverage container with illuminable arrangement, which elevated container lid can prevent splashing and spilling out of the beverage contained in the container bottle.

Another advantage of the invention is to provide a beverage container with illuminable arrangement, wherein the illuminable arrangement includes a mounting site recessed in a bottom of the container bottle and an illumination device configured to be detachably mounted in the mounting site so as to project illuminating lights into an interior cavity of the container bottle upwardly.

Another advantage of the invention is to provide a beverage container with illuminable arrangement, wherein a curved surrounding wall of a container bottle provides light reflecting and refracting effects to the illuminating lights projected from an illumination device mounted at a bottom of the container bottle coaxially.

Additional advantages and features of the invention will become apparent from the description which follows and may be realized by means of the instrumentalities and combinations particular point out in the appended claims.

According to the present invention, the foregoing and other objects and advantages are attained by a beverage container, including a container bottle having a surrounding wall, a bottom wall, a top end, and a top opening coaxially formed at the top end, wherein an interior cavity is defined between the bottom wall and the top end; and an elevated container lid which includes a lid member detachably and coaxially connected to the top end of the container bottle to cover the top opening of the container bottle, and a hollow elevated drinking spout member having a base portion coaxially mounted on the lid member, a mouthpiece portion integrally and coaxially extended from the base portion, and a drinking opening coaxially formed at a top end of the mouthpiece portion, wherein the mouthpiece portion of the elevated drinking spout member has a nipple shape and the drinking opening has a size equal to or slightly larger than a diameter of a straw to be inserted therethrough into the interior cavity until reaching the bottom wall of the container bottle.

In one embodiment, the base portion of the elevated drinking spout member gradually reduces a diameter thereof to form a bowl shape hollow body and the tubular mouthpiece portion is a tubular body gradually reducing a diameter thereof to a top round end thereof, wherein the drinking opening is coaxially formed at the top round end such that a user may selectively contain the mouthpiece portion in his or her mouth to drink through the drinking opening directly or drink through a straw coaxially inserting through the drinking opening while the straw is retained in an upright position thereof by the mouthpiece portion and vertically and downwardly extended to the bottom wall of the container bottle.

In one embodiment, the beverage container further includes an illuminable arrangement which includes a mounting site and an illuminating device. The mounting site is formed by a circular accommodating slot recessed in the bottom of the container bottle. In other words, a circular retaining wall is integrally and inwardly indented from the bottom wall coaxially into the interior cavity so as to define the accommodating slot as the mounting site. An enlarged retaining recess is formed below the accommodating slot for retaining the illuminating device in the accommodating slot. The illuminating device includes a retainer and a LED lighting unit, wherein the retainer which is sized and configured to be detachably mounted in the accommodating slot has a receiving chamber for installing the LED lighting unit and a retaining rim outwardly extended for mounting at the retaining recess so as to retain the LED lighting unit within the accommodating slot. The LED lighting unit comprises a LED circuit board, one or more LEDs electrically connected on the LED circuit board such that when the LED lighting unit is accommodated in the mounting site, the one or more LEDs may generate lights projecting towards the interior cavity of the container bottle, and a switch for switching on-and-off and controlling illumination patterns of the one or more LEDs.

In one embodiment, the container bottle is made of translucent material and the surrounding wall of the container bottle has a wave cross-sectional shape so as to function as a light reflecting surface to reflect the lights emitting from the LEDs of the illuminating device.

Still further objects and advantages will become apparent from a consideration of the ensuing description and drawings.

These and other objectives, features, and advantages of the present invention will become apparent from the following detailed description, the accompanying drawings, and the appended claims.

Figure 1A:
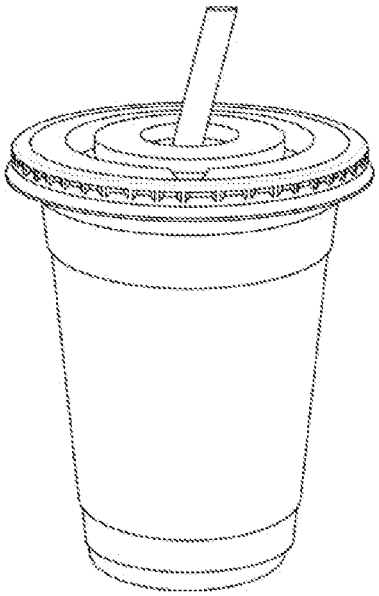
FIG. 1A PRIOR ART
FIG. 1A is a perspective view of a conventional straw-type travel cup.
Figure 1B:
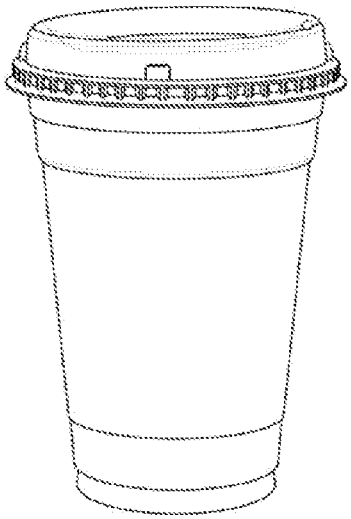
FIG. 1B PRIOR ART
FIG. 1B is a perspective view of a conventional spout-type travel cup.

The drawings, described above, are provided for purposes of illustration, and not of limitation, of the aspects and features of various examples of embodiments of the invention described herein. The drawings are not intended to limit the scope of the claimed invention in any aspect. For simplicity and clarity of illustration, elements shown in the drawings have not necessarily been drawn to scale and the dimensions of some of the elements may be exaggerated relative to other elements for clarity.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

It will be appreciated that numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure the embodiments described herein. Further, this description is not to be considered as limiting the scope of the embodiments described herein in any way, but rather as merely describing implementation of the one or more embodiments described herein.

Referring to FIG. 2 to FIG. 6, a beverage container 1 with illuminable arrangement according to a preferred embodiment of the present invention is illustrated, wherein the beverage container 1 comprises a container bottle 10 and an elevated container lid 20. The container bottle 10 is made of translucent material and has a curved surrounding wall 11, a bottom wall 12, a top end 13 and a top opening 14, wherein an interior cavity 15 is defined between the bottom wall 12 and the top opening 14. The surrounding wall 11 has a wave cross-sectional shape so as to function as a light refraction surface. According to the preferred embodiment, the container bottle 10 has a gourd shape such that the surrounding wall 11 has a concave curved lower wall surface 111, a concave curved upper wall surface 112 and a convex curved mid wall surface 113 between the concave curved the lower and upper wall surface 111, 112, such that the concave curved lower and upper wall surfaces 111, 112 and the convex curved mid wall surface 113 are able to refract lights in various different directions.

It is worth mentioning that the wave form curved surrounding wall 11 of the container bottle 10 also facilitates the user to hand hold firmly especially to the container bottle 10 having a diameter as large as 10 cm or more and a height as tall as 20 cm or more. Top end 13 of the container bottle 10 has a first fastening element 131, implemented as a threaded portion according to the preferred embodiment.

Figure 2:
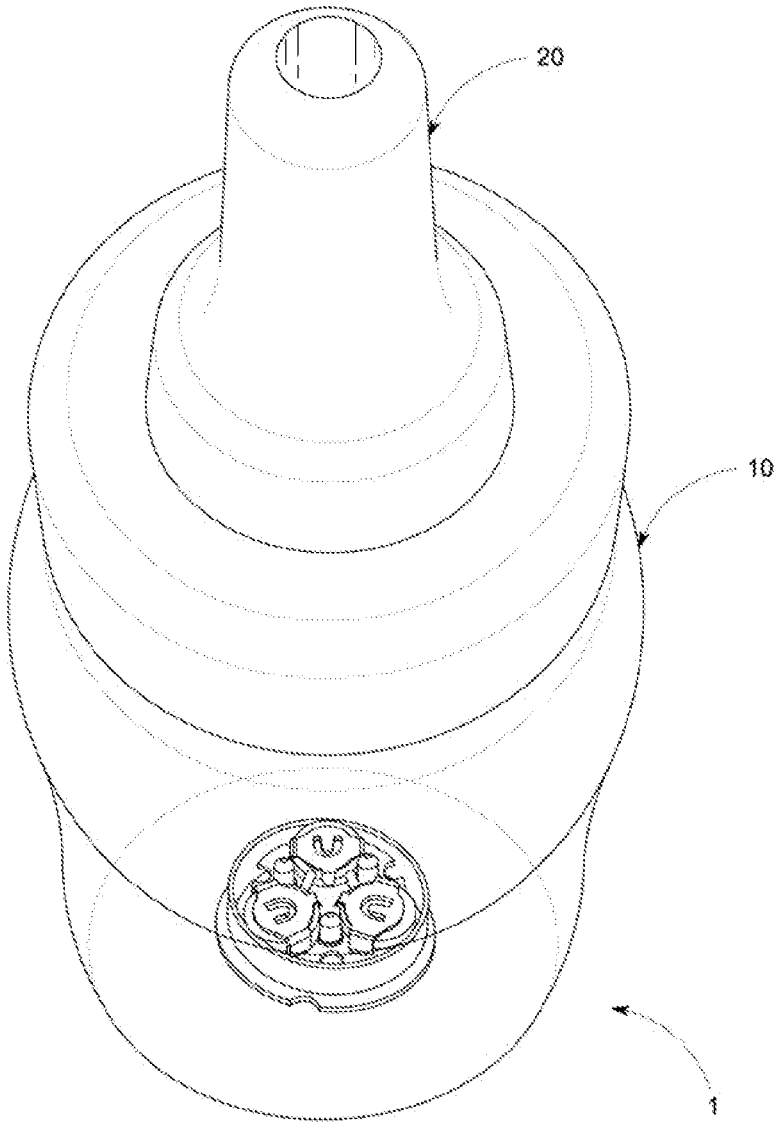
FIG. 2 is a perspective view of a beverage container with illuminable arrangement according to a preferred embodiment of the present invention.
Figure 3A:
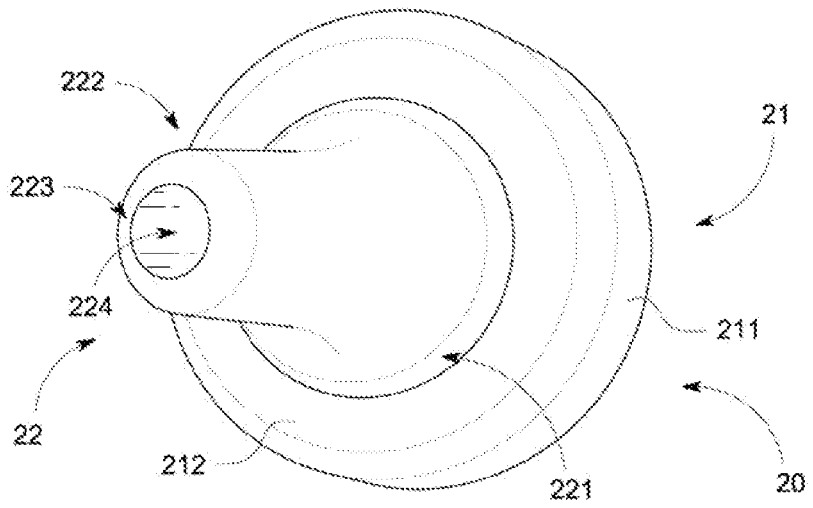
FIG. 3A is a front perspective view of an elevated container lid of the beverage container according to the above preferred embodiment of the present invention.
Figure 3B:
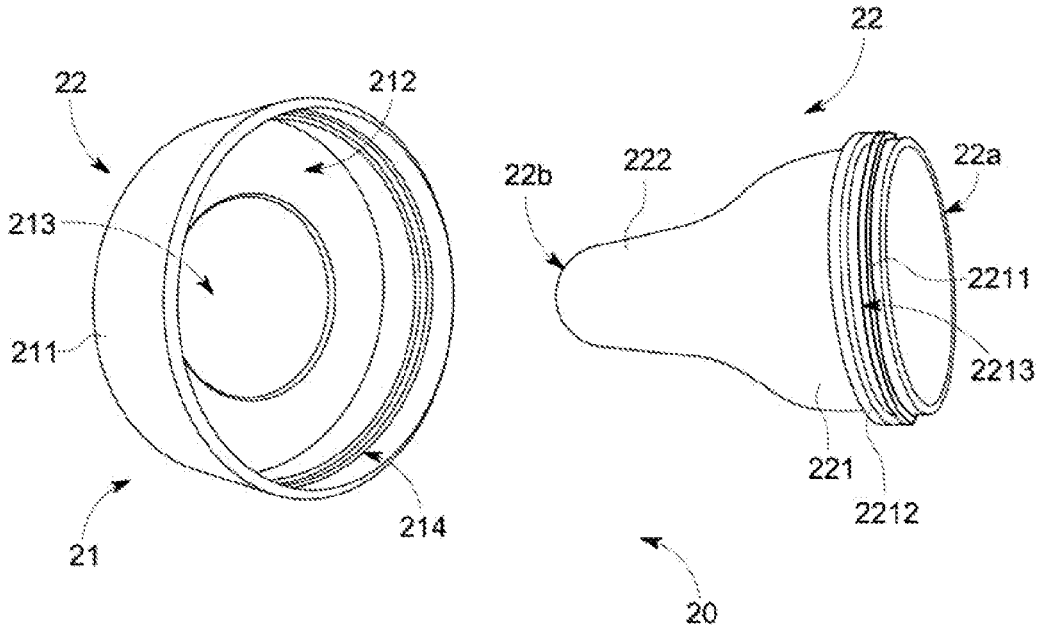
FIG. 3B is an exploded view of the elevated container lid of the beverage container according to the above preferred embodiment of the present invention.
Figure 4:
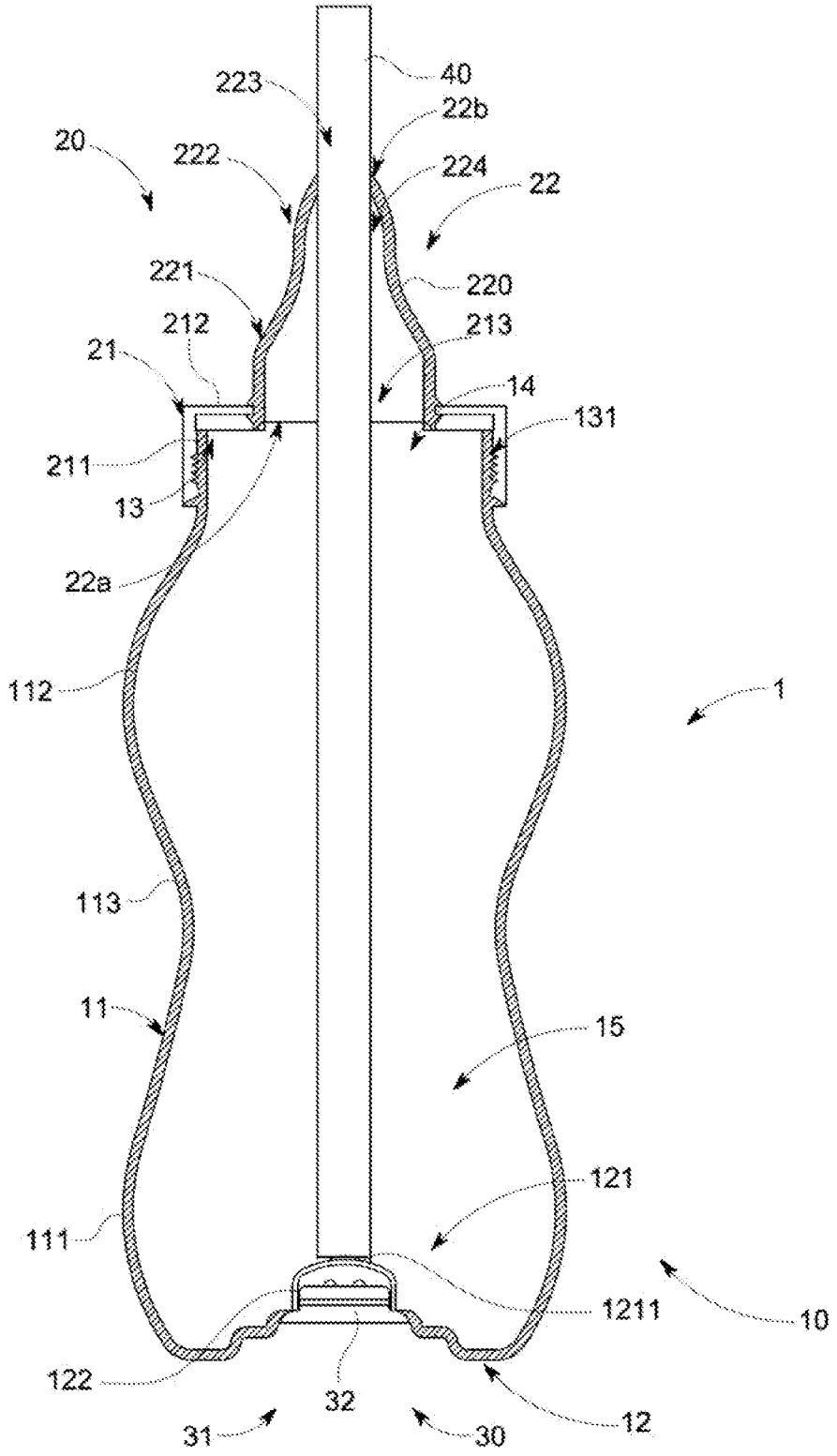
FIG. 4 is a sectional view illustrating the beverage container with illuminable arrangement according to the above preferred embodiment of the present invention.

Referring to FIG. 2 to FIG. 4, the elevated container lid 20 includes a lid member 21 and an elevated drinking spout member 22. The lid member 21 is detachably and coaxially engaged to the top end 13 of the container bottle 10 to cover the top opening 14 of the container bottle 10. The elevated drinking spout member 22 is a hollow body coaxially mounted on the lid member 21.

As shown in FIG. 3A and FIG. 3B, both the lid member 21 and the elevated drinking spout member 22 are made of plastic material. The lid member 21 has a L-shaped cross section forming a circular side wall portion 211 and an upper wall portion 212 inwardly extended from a top end of the side wall portion 211 to define a central spout opening 213. A second fastening element 214 is formed on an inner surface of the side wall portion 211, which is implemented as a threaded portion according to the preferred embodiment and configured for fittingly screwed with the first fastening element 131 of the top end 13 of the container bottle 10 so as to fittingly connect the lip member 21 to the top end 13 of the container bottle 10 to cover the top opening 14 of the container bottle 10 in a coaxial manner, as shown in FIG. 4.

It is worth mentioning that, for ease of illustration purpose, the FIG. 4 is a sectional schematic view with a wall thickness of the container bottle 10 and the elevated drinking spout member 22 thicker than the actual product. According to the preferred embodiment, the elevated drinking spout member 22 has a circular wall 220 upwardly and inwardly extended from a bottom end 22A to a top round end 22B thereof to define a base portion 221 configured to be coaxially mounted on the lid member 21 and a mouthpiece portion 222 integrally and coaxially extended from the base portion 221, wherein a drinking opening 223 is coaxially formed in the top round end 22B and communicating with the spout opening 213 of the lid member 21 and the top opening 14 and the interior cavity 15 of the container bottle 10. The base portion 221 gradually reduces a diameter thereof to form a circular base wall having a predetermined curvature. The mouthpiece portion 222 has a nipple shape and a tubular wall upwardly extended from the base wall to define a guiding chamber 224 therein. The drinking opening 223 formed at the top round end 22B has a size equal to or slightly larger than a diameter of a straw 40 to be inserted therethrough, as shown in FIG. 4, into the interior cavity 15 until reaching the bottom wall 12 of the container bottle 10. Since the guiding chamber 224 has a diameter merely slightly larger than the diameter of the straw 40 and a predetermined height, the extending straw 40 is guided and retained by the guiding chamber 224 is a relatively upright position to facilitate the consuming of the beverage contained in the container bottle 10, as shown in FIG. 4.

Preferably, the elevated drinking spout member 22 is rotatably mounted to the lid member 21, wherein two parallel ring-shape flanges 2211, 2212 protruded from a root portion of an outer surface of the base portion 22 defining a circular mounting groove 2213 therebetween which has a diameter equal to or slightly smaller than the diameter of the spout opening 213 of the lid member 21 and a width equal to or slightly larger than a thickness of a circular rim defining the spout opening 213 (i.e. a thickness of the upper wall portion 212 according to the preferred embodiment) of the lid member 21, such that the elevated drinking spout member 22 is able to assemble with the lid member 21 to form the elevated drinking spout member 22 by engaging the circular rim defining the spout opening 213 in the mounting groove 2213 in a rotatable manner, as shown in FIG. 3B and FIG. 4.

To user who prefers to drink through a straw, the user may insert the straw 40 into the container bottle 10 through the drinking opening 223 until reaching the bottom wall 12. To user who prefers to drink directly with his or her mouth or to pour the beverage contained in the container bottle 10, the user may simply contain the mouthpiece portion 222 in his or her mouth or to pour out the beverage contained in the container bottle 10 through the drinking opening 223 via the spout opening 213, wherein the reduced size of the guiding chamber 224 significantly controls a steady flow of the beverage from the interior cavity 15 out through the drinking opening 223. In addition, the elevated height of the elevated drinking spout member 20 can avoid the beverage contained in the container bottle 10 from splashing and spilling out accidently while traveling and carrying by the user.

When beverage such as boba flavored milk tea or juice with crushed fruits is contained in the container bottle 10 and the straw 40 is used, it will be appreciated for an arrangement for preventing the boba or the small pieces of fruit from entering and stucking the straw. According to the preferred embodiment, referring to FIG. 4, a central portion of the bottom wall 12 is inwardly protruded to form a straw resting platform 121 which is elevated from an inner side of the bottom wall 12 into the interior cavity 15 for a predetermined height and has a ceiling wall 1211 such that a bottom end of the straw 40 which is guided by the guiding chamber 224 extending in the upright position can rest and be maintained thereon while a convex surface of the ceiling wall 1211 prevents the boba or other small particles in the beverage from resting thereon and entering the straw 40. The container bottle 10 is made by plastic molding that the straw resting platform 121 is molded to form integrally at the same time. An unexpected result is achieved with the arrangement of the straw resting platform 121 that the outer side of the bottom wall 12 is correspondingly recessed to form a circular accommodating slot 311 and the ceiling wall 1211 having a concave bottom surface functions as a projecting lens 310 of the accommodating slot 311 for light beams.

Figure 5:
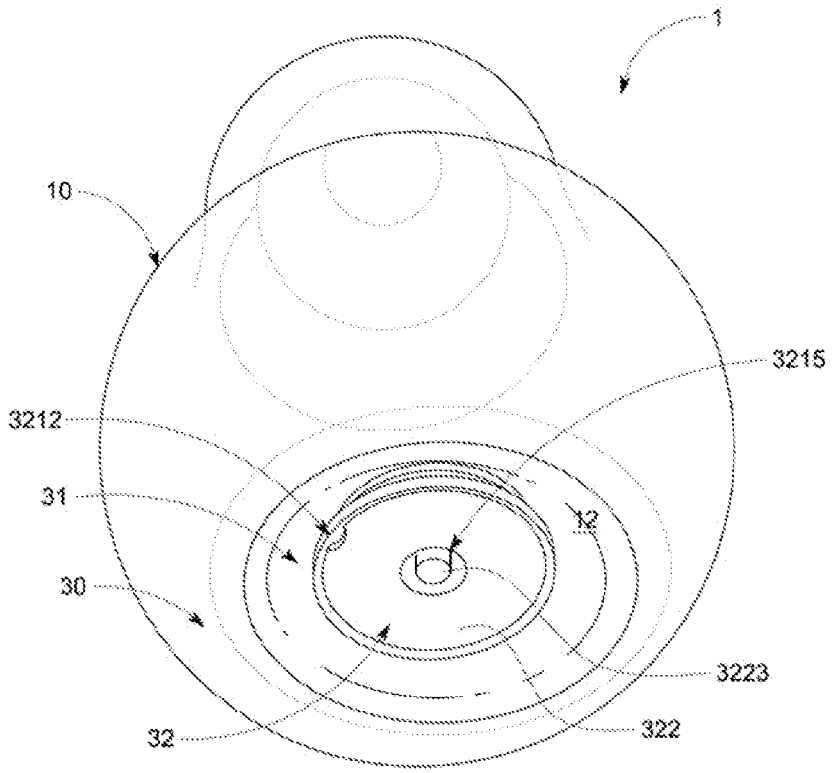
FIG. 5 is a bottom perspective view of the of the beverage container with illuminable arrangement according to the above preferred embodiment of the present invention.
Figure 6:
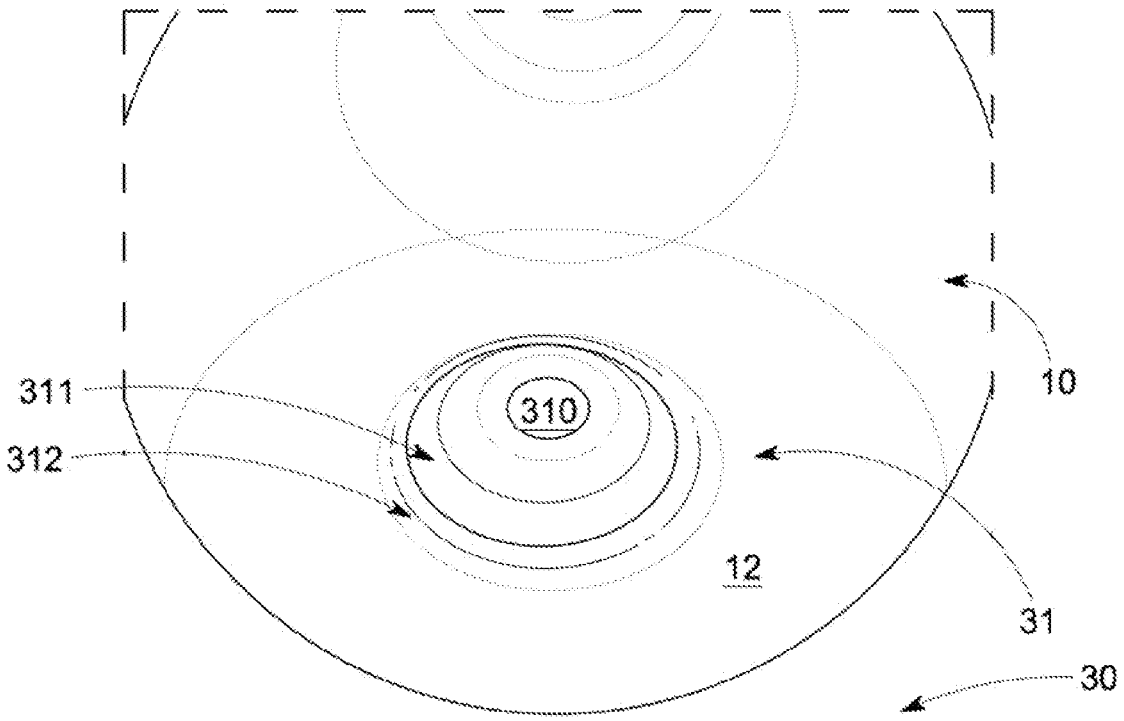
FIG. 6 is an exploded view of the illuminable arrangement of the beverage container according to the above preferred embodiment of the present invention.
Figure 6:
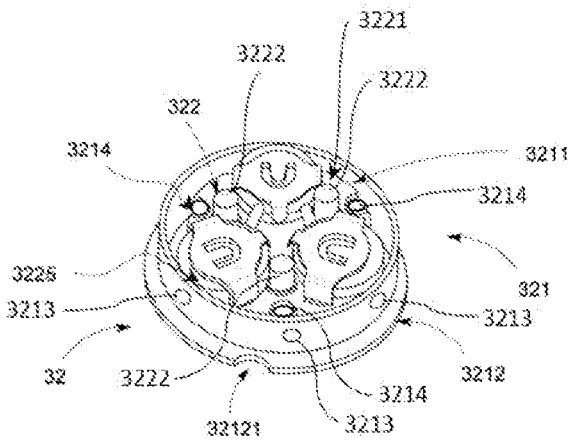

Referring to FIG. 4 to FIG. 8B, accordingly, the beverage container 1 of the present invention further includes an illuminable arrangement 30 which includes a mounting site 31 and an illuminating device 32. The mounting site 31 is formed by the circular accommodating slot 311. In other words, a circular retaining wall 122 is integrally and inwardly indented from the bottom wall 12 coaxially into the interior cavity 15 so as to define the accommodating slot 311 as the mounting site 31 according to the preferred embodiment of the present invention. The bottom wall 12 is preferred to be a concave wall. The mounting site 31 further has an enlarged retaining recess 312 formed below the accommodating slot 311, as shown in FIG. 6.

When the beverage container 1 is merely used as a container for beverage, the illuminating device 32 has no need to assemble with the beverage container 10. However, the beverage container 1 can also be a decorative tool and the illuminable arrangement 30 further includes an illuminating device 32 as an accessory component to be assembled with the container bottle 10 when the user would like to perform a decorative function for beverage container 1 when it is used during a party, a carnival, a banquet venue, and the like.

The illuminating device 32 includes a circular retainer 321 and a LED (Light Emitting Diode) lighting unit 322, referring to FIG. 5 to FIG. 6, wherein the retainer 321 is sized and configured to be detachably mounted in the accommodating slot 311. The retainer 321 has a receiving chamber 3211 for installing the LED lighting unit 322 and a retaining rim 3212 outwardly extended for mounting at the retaining recess 312 so as to detachably retain the LED lighting unit 322 within the accommodating slot 311. The LED lighting unit 322 includes a circuit board 3221, one or more LEDs 3222 electrically connected on the circuit board 3221 for generating and projecting lights into the interior cavity 15 through the projecting lens 310 and a switch 3233 arranged for switching on-and-off and controlling illumination patterns of the one or more LEDs 3222, such that when the LED lighting unit 322 is accommodated in the mounting site 31, the one or more LEDs may generate lights projecting towards the interior cavity 15 through the projecting lens 310 of the container bottle 10.

According to the preferred embodiment, as shown in FIG. 6, the circular retainer 321 has a U-shape cross section and a diameter slightly smaller than a diameter of the accommodating slot 311 and one or more protuberances 3213 protruded outwards around the retainer 321 so as to enlarge an overall outer diameter slightly larger than the diameter of the accommodating slot 311 such that the retainer 321 can be squeezed in the accommodating slot 311 and fixedly mounted in the accommodating slot 311 while the protuberances 3213 pressing against the retaining wall 122 defining the accommodating slot 311. The retaining rim 3212 which rests in the retaining recess 312 has a notch 32121 configured for the user to detach the illuminating unit 321 from the accommodating slot 311.

In order to align and mount the illuminating unit 322 in the receiving chamber 3211, two or more retaining pins 3214 are protruded on a bottom surface of the retainer 321 and the circuit board 3221 has two or more retaining notches 3224 formed corresponding to allow the two or more retaining pins 3214 to be fittingly inserted therethrough respectively and correspondingly so as to firmly retain the illuminating unit 322 in the receiving camber 3211, as shown in FIG. 6.

The retainer 321 further has a central hole 3215 formed therein, as shown in FIG. 5. The switch 3223, which is electrically connected to the circuit board 3221, is projected downwardly from a bottom side of the circuit board 3221 and adapted to extend through the central hole 3215 of the retainer 321 to expose outside so as to allow the user to operate and control the illuminating unit 322, as shown in FIG. 5 and FIG. 6. The circuit board 3221 is provided with a power supply 3225 including one or more batteries supplying electrical power to the LEDs 3222, as shown in FIG. 6.

Figure 7:
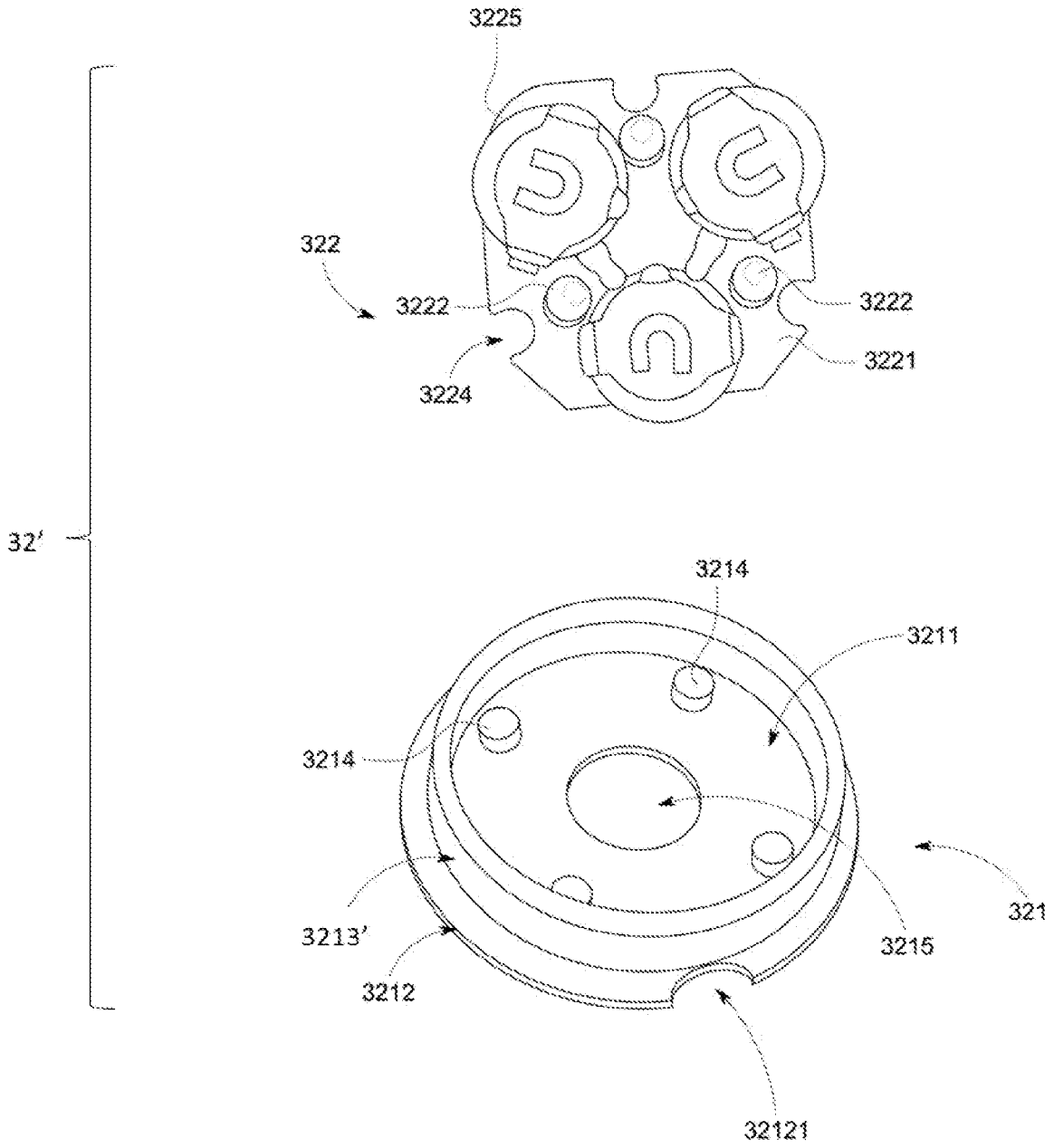
FIG. 7 is an exploded view illustrating an alternative mode of the illuminable device of the beverage container according to the above preferred embodiment of the present invention.

FIG. 7 illustrates an alternative mode of the illuminable device 32' which basically has the same configuration of the illuminable device 32 as shown in the FIG. 6 except that the circular retainer 321 has a taper outer wall 3213' gradually reducing an outer diameter from the retaining rim 3212 to a top edge thereof that allows the retainer 321 to be squeezed in the accommodating slot 311 and fixedly mounted in the accommodating slot 311 while the tape outer wall 3213' pressing against the retaining wall 122 defining the accommodating slot 311.

The LEDs 3222 of the illuminable device 32, 32, as shown in FIG. 6 and FIG. 7, are projected on a top side of the circuit board 3221 such that after the illuminating device 32 is mounted in the accommodating slot 311, the LEDs 3222 is located in the accommodating slot 311 for generating lights projecting into the interior cavity 15 of the container bottle 10 through the projecting lens 310. The LEDs 3222 can be arranged to provide different colored lights, such as red, blue and green, and be controlled by the switch 3223 to generate different colors of light intervally, flashing lights and etc. Since the illuminating unit 322, the container bottle 10 and the elevated drinking spout member 22 are arranged and aligned coaxially, so that the lights projected from the LEDs 3222 are firstly projected to various directions into the interior cavity 15 and then projected onto the curved surrounding wall 11 of the container bottle 10, the elevated drinking spout member 22 and even the straw 40 inserted into the interior cavity 15 to produce decorative flashing light spots within the beverage container 1.

Figure 8:
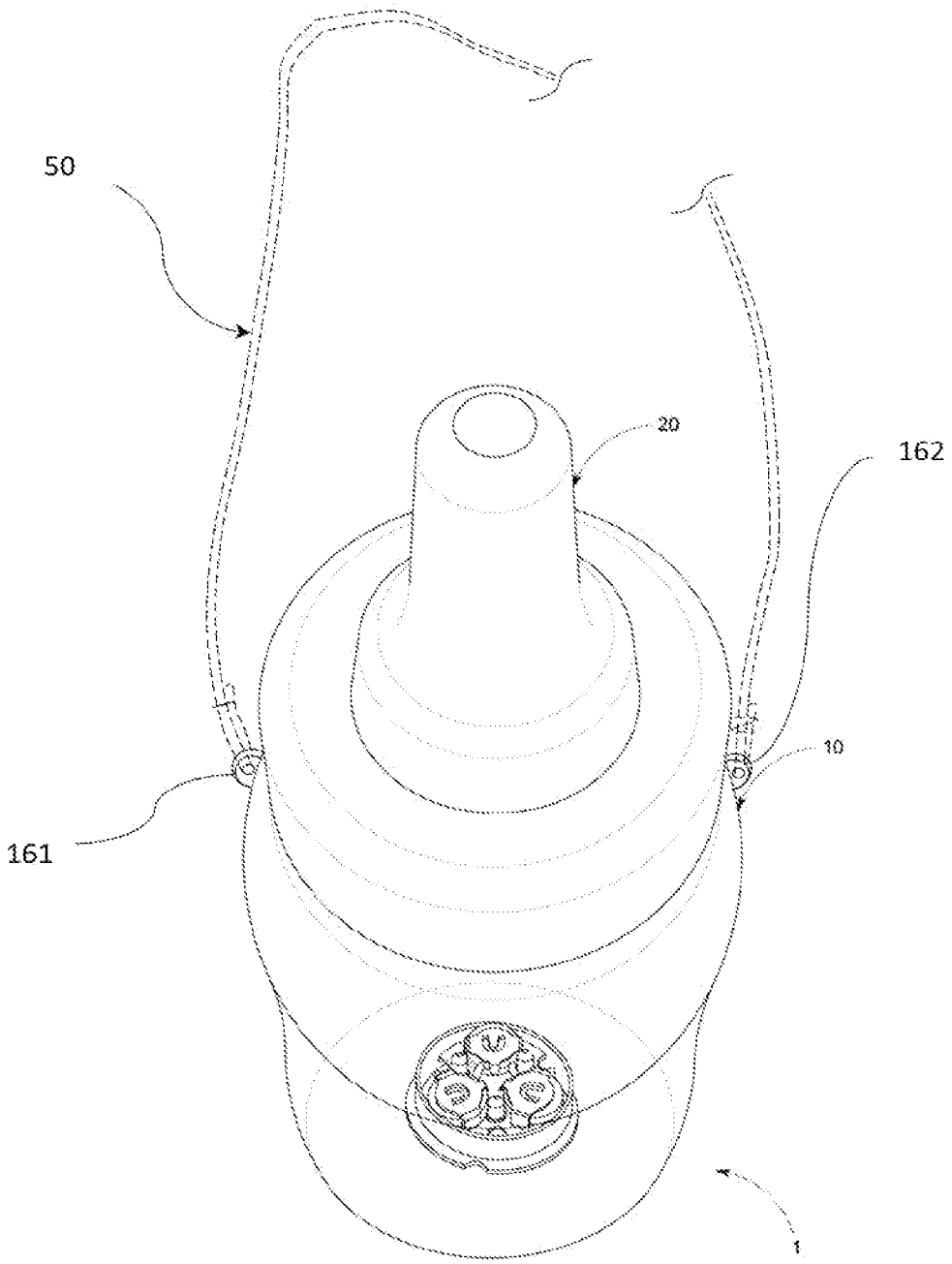
FIG. 8 is a perspective view of an alternative mode of the beverage container with illuminable arrangement according to the above preferred embodiment of the present invention.

Referring to FIG. 8, an alternative mode of the beverage container with illuminable arrangement according to the above preferred embodiment of the present invention is illustrated, wherein the container bottle 10 further comprises two ring-shaped hangers 161, 162 integrally provided at two opposing sides thereof so that an elongated hanging element 50 can be attached to the container bottle 10 by connecting two end portions thereof to the two hangers 161, 162 such that the user may hang the beverage container 1 to his or her body via the hanging element 50 for ease of carrying.

Figure 9:
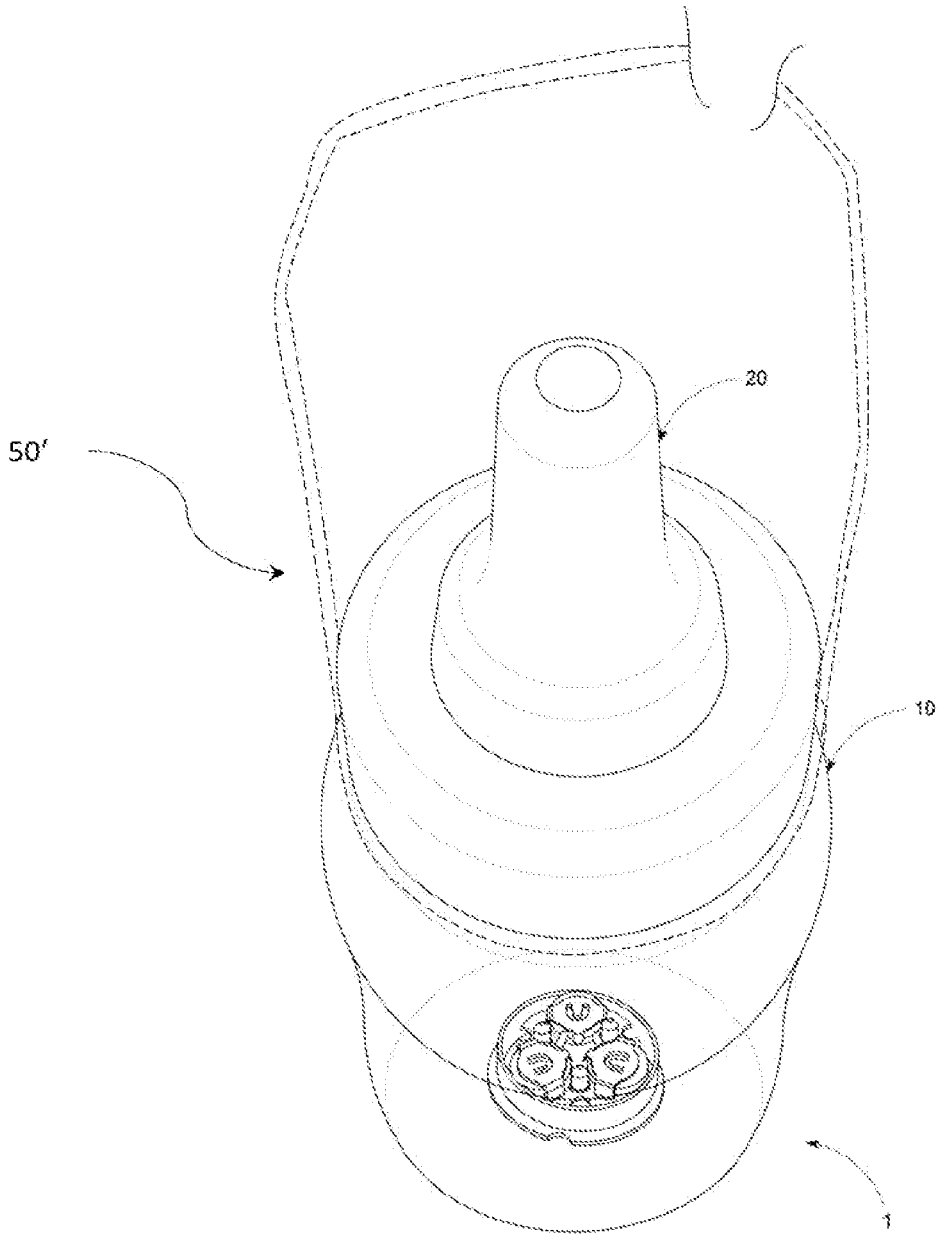
FIG. 9 is a perspective view of another alternative mode of the beverage container with illuminable arrangement according to the above preferred embodiment of the present invention.

Referring to FIG. 9, another alternative mode of the beverage container with illuminable arrangement according to the above preferred embodiment of the present invention is illustrated, wherein an elongated belt or strap 50' may be fasten to the container bottle 10 positioned below the container lid 20 for allowing the user to hang the beverage container 1 to his or her body for ease of carrying.

In other words, the curved surrounding wall 11 of the container bottle 1 provides light reflecting and refracting effects to the illuminating lights projected from the illumination device 30. The arrangement of the straw resting platform 122 also forms the mounting site 31 of the illuminating device 30 at the same time without any additional component while the convex ceiling wall 1211 forms the projecting lens 310 too. Therefore, the beverage container 1 of the present invention can provide multiple functions without incorporating complicated structure that substantially minimizes the manufacturing cost thereof.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A beverage container, comprising:

a container bottle having a surrounding wall, a bottom wall, a top end, and a top opening coaxially formed at said top end, wherein an interior cavity is defined between said bottom wall and said top end, wherein a central portion of said bottom wall is inwardly protruded to form a straw resting platform which is elevated from an inner side of said bottom wall into said interior cavity for a predetermined height and has a ceiling wall, wherein, correspondingly, an outer side of said bottom wall is recessed to form an accommodating slot and said ceiling wall functions as a projecting lens of said accommodating slot; and an elevated container lid, which includes a lid member, having a spout opening, detachably and coaxially connected to said top end of said container bottle to cover said top opening of said container bottle, and a hollow elevated drinking spout member having a base portion coaxially mounted on said lid member, a mouthpiece portion integrally and coaxially extended from said base portion, and a drinking opening coaxially formed at a top end of said mouthpiece portion and communicating with said spout opening of said lid member and said top opening and said interior cavity of said container body, wherein said mouthpiece portion of said elevated drinking spout member has a nipple shape and said drinking opening has a size equal to or slightly larger than a diameter of a straw to be inserted therethrough into said interior cavity until reaching said bottom wall of said container bottle.

2. The beverage container, as recited in claim 1, further including an illuminable arrangement which includes a mounting site and an illuminating device, wherein said mounting site is formed by said accommodating slot of said container bottle and said illuminating device is accommodated in said accommodating slot to generate lights projecting into said interior cavity of said container bottle through said projecting lens.

3. The beverage container, as recited in claim 2, wherein said container bottle is made of translucent material and said surrounding wall of said container bottle has a wave cross sectional shape so as to function as a light refraction surface.

4. The beverage container, as recited in claim 2, wherein said illuminating device includes a retainer and an LED (Lighting Emitting Diode) lighting unit, wherein said retainer is sized and configured to be fittingly accommodated in said accommodating slot and has a receiving chamber configured to receive said LED lighting unit therein, wherein said LED lighting unit includes a circuit board, one or more LEDs electrically connected on said circuit board for generating and projecting lights into said interior cavity through said projecting lens and a switch arranged for switching on-and-off and controlling illumination patterns of said one or more LEDs.

5. The beverage container, as recited in claim 3, wherein said illuminating device includes a retainer and an LED (Lighting Emitting Diode) lighting unit, wherein said retainer is sized and configured to be fittingly accommodated in said accommodating slot and has a receiving chamber configured to receive said LED lighting unit therein, wherein said LED lighting unit includes a circuit board, one or more LEDs electrically connected on said circuit board for generating and projecting lights into said interior cavity through said projecting lens and a switch arranged for switching on-and-off and controlling illumination patterns of said one or more LEDs.

6. The beverage container, as recited in claim 2, wherein said mounting site further has an enlarged retaining recess formed below said accommodating slot and said retainer further has a retaining rim outwardly extended for mounting at said retaining recess so as to detachably retain said LED lighting unit within said accommodating slot.

7. The beverage container, as recited in claim 3, wherein said mounting site further has an enlarged retaining recess formed below said accommodating slot and said retainer further has a retaining rim outwardly extended for mounting at said retaining recess so as to detachably retain said LED lighting unit within said accommodating slot.

8. The beverage container, as recited in claim 4, wherein said mounting site further has an enlarged retaining recess formed below said accommodating slot and said retainer further has a retaining rim outwardly extended for mounting at said retaining recess so as to detachably retain said LED lighting unit within said accommodating slot.

9. The beverage container, as recited in claim 1, further comprising an elongated element configured to fasten to said container body for hanging said beverage container to a body of the user.

10. The beverage container, as recited in claim 2, further comprising an elongated element configured to fasten to said container body for hanging said beverage container to a body of the user.

11. The beverage container, as recited in claim 4, further comprising an elongated element configured to fasten to said container body for hanging said beverage container to a body of the user.

12. The beverage container, as recited in claim 9, wherein said container bottle further comprises two hangers provided at two opposing sides thereof and said elongated element is attached to said container bottle by connecting two end portions thereof to said two hangers.

13. The beverage container, as recited in claim 10, wherein said container bottle further comprises two hangers provided at two opposing sides thereof and said elongated element is attached to said container bottle by connecting two end portions thereof to said two hangers.

14. The beverage container, as recited in claim 11, wherein said container bottle further comprises two hangers provided at two opposing sides thereof and said elongated element is attached to said container bottle by connecting two end portions thereof to said two hangers.

15. A beverage container, comprising:

a container bottle having a surrounding wall, a bottom wall, a top end, and a top opening coaxially formed at said top end, wherein an interior cavity is defined between said bottom wall and said top end, wherein a central portion of said bottom wall is inwardly protruded to form a straw resting platform which is elevated from an inner side of said bottom wall into said interior cavity for a predetermined height and has a ceiling wall having a convex curved surface, wherein an outer side of said bottom wall is correspondingly recessed to form an accommodating slot and said ceiling wall functions as a projecting lens of said accommodating slot; and an elevated container lid, which includes a lid member, having a spout opening, detachably and coaxially connected to said top end of said container bottle to cover said top opening of said container bottle, and a hollow elevated drinking spout member having a base portion coaxially mounted on said lid member, a mouthpiece portion integrally and coaxially extended from said base portion, and a drinking opening coaxially formed at a top end of said mouthpiece portion and communicating with said spout opening of said lid member and said top opening and said interior cavity of said container body, wherein said mouthpiece portion of said elevated drinking spout member has a nipple shape and said drinking opening has a size equal to or slightly larger than a diameter of a straw to be inserted therethrough into said interior cavity until reaching said bottom wall of said container bottle, wherein said base portion of said elevated drinking spout member gradually reduces a diameter thereof to form a circular base wall having a predetermined curvature and said mouthpiece portion has a tubular wall upwardly extended from said base wall of said base portion to define a guiding chamber therein, wherein said drinking opening is coaxially formed at said top end of said mouthpiece portion, such that said mouthpiece portion is capable of being selectively contained in a mouth of a user to drink through said drinking opening directly or drink through the straw coaxially inserting through said drinking opening while the straw is retained in an upright position by said mouthpiece portion and vertically and downwardly extended to said bottom wall of said container bottle.

16. The beverage container, as recited in claim 15, further including an illuminable arrangement which includes a mounting site and an illuminating device, wherein said mounting site is formed by said accommodating slot of said container bottle and said illuminating device is accommodated in said accommodating slot to generate lights projecting into said interior cavity of said container bottle through said projecting lens.

17. The beverage container, as recited in claim 16, wherein said container bottle is made of translucent material and said surrounding wall of said container bottle has a wave cross sectional shape so as to function as a light refraction surface, wherein said container bottle has a gourd shape such that said surrounding wall has a concave curved lower wall surface, a concave curved upper wall surface and a convex curved mid wall surface between said concave curved lower wall surface and said concave curved upper wall surface.

18. The beverage container, as recited in claim 16, wherein said illuminating device includes a retainer and an LED (Lighting Emitting Diode) lighting unit, wherein said retainer is sized and configured to be fittingly accommodated in said accommodating slot and has a receiving chamber configured to receive said LED lighting unit therein, wherein said LED lighting unit includes a circuit board, one or more LEDs electrically connected on said circuit board for generating and projecting lights into said interior cavity through said projecting lens and a switch electrically connected to said circuit board for switching on-and-off and controlling illumination patterns of said one or more LEDs.

19. The beverage container, as recited in claim 17, wherein said illuminating device includes a retainer and an LED (Lighting Emitting Diode) lighting unit, wherein said retainer is sized and configured to be fittingly accommodated in said accommodating slot and has a receiving chamber configured to receive said LED lighting unit therein, wherein said LED lighting unit includes a circuit board, one or more LEDs electrically connected on said circuit board for generating and projecting lights into said interior cavity through said projecting lens and a switch electrically connected to said circuit board for switching on-and-off and controlling illumination patterns of said one or more LEDs.

20. The beverage container, as recited in claim 16, wherein said mounting site further has an enlarged retaining recess formed below said accommodating slot and said retainer further has a retaining rim outwardly extended for mounting at said retaining recess so as to detachably retain said LED lighting unit within said accommodating slot, wherein said retainer has an overall outer diameter configured to be fittingly mounted in said accommodating slot while an outer wall of said retainer pressing against a retaining wall defining said accommodating slot.

21. The beverage container, as recited in claim 17, wherein said mounting site further has an enlarged retaining recess formed below said accommodating slot and said retainer further has a retaining rim outwardly extended for mounting at said retaining recess so as to detachably retain said LED lighting unit within said accommodating slot, wherein said retainer has an overall outer diameter configured to be fittingly mounted in said accommodating slot while an outer wall of said retainer pressing against a retaining wall defining said accommodating slot.

22. The beverage container, as recited in claim 18, wherein said mounting site further has an enlarged retaining recess formed below said accommodating slot and said retainer further has a retaining rim outwardly extended for mounting at said retaining recess so as to detachably retain said LED lighting unit within said accommodating slot, wherein said retainer has an overall outer diameter configured to be fittingly mounted in said accommodating slot while an outer wall of said retainer pressing against a retaining wall defining said accommodating slot.

23. The beverage container, as recited in claim 19, wherein said mounting site further has an enlarged retaining recess formed below said accommodating slot and said retainer further has a retaining rim outwardly extended for mounting at said retaining recess so as to detachably retain said LED lighting unit within said accommodating slot, wherein said retainer has an overall outer diameter configured to be fittingly mounted in said accommodating slot while an outer wall of said retainer pressing against a retaining wall defining said accommodating slot, wherein said retainer has a central hole formed therein and said switch is projected downwardly from a bottom side of said circuit board and adapted to extend through said central hole of said retainer to expose outside.

* * * * *